US006557186B1

(12) United States Patent
Purnell

(10) Patent No.: US 6,557,186 B1
(45) Date of Patent: May 6, 2003

(54) LIGHTWEIGHT PROTECTIVE EAR GUARD

(76) Inventor: John W Purnell, 406 Lawrence Ave., West Lawn, PA (US) 19609

( * ) Notice: Subject to any disclaimer, the term of this patent is extended or adjusted under 35 U.S.C. 154(b) by 0 days.

(21) Appl. No.: 10/112,777

(22) Filed: Apr. 2, 2002

(51) Int. Cl.[7] ..... A63B 71/10
(52) U.S. Cl. ..... 2/425; 2/209; 40/329
(58) Field of Search ..... 2/425, 423, 209; 40/329

(56) References Cited

U.S. PATENT DOCUMENTS 4,551,861 A * 11/1985 Marchello ..... 2/425
6,289,522 B1 * 9/2001 Jones et al. ..... 2/425

* cited by examiner

*Primary Examiner*—Rodney M. Lindsey
(74) *Attorney, Agent, or Firm*—Sherman & Shalloway

(57) ABSTRACT

The present invention provides a lightweight protective ear guard which relies on an outer air cushion created between a semi-rigid inner shell and a resilient outer shell to provide a multi-level degree of shock absorbency and protection for the ears. The wearable structures comprising a pair of ear guards connected by a plurality of adjustable strap members are provided for particular use by wrestlers to protect their ears from injury due to contact with wrestling surface and other wrestlers.

20 Claims, 2 Drawing Sheets

LIGHTWEIGHT PROTECTIVE EAR GUARD

FIELD OF THE INVENTION

This invention relates to a lightweight protective ear guard which relies on an outer air cushion created between a semi-rigid inner shell and a resilient outer shell to provide a multi-level degree of shock absorbency and protection for the ears. The wearable structures comprising a pair of ear guards connected by a plurality of adjustable strap members are provided for particular use by wrestlers to protect their ears from injury due to contact with wrestling surface and other wrestlers.

BACKGROUND OF THE INVENTION

Amateur wrestlers are subjected to maneuvers and contact with opponents and the wrestling mat which can result in injuries to the outer ear surfaces. Such injuries can be the result of unintentional blows to the ear by opponents, abrasion by sliding contact with the mat, ie., mat burn, and unintentional head contact between opponents, ie., head butts. As a means of protecting against such injuries, ear guard devices are in wide-spread use and generally provide a reinforced cup shaped protector covering the ears.

Most ear guards are deficient in the level of protection they provide to both the wearer and opponents, either because of insufficient padding and thus reduced shock absorbency or because their construction results in a high profile which can catch on opponents', clothing or equipment. Other ear guards are complex in their construction and strap arrangement which renders them uncomfortable and difficult to adjust on the wearer for proper protection.

In his U.S. Pat. No. 5,504,945, the inventor herein provided an improved ear guard assembly of the type comprising an inner rigid shell with outer shock absorbing foam held in place by an overall encompassing molded flexible outer covering. A plurality of straps attaching directly to the rigid shell interconnect the ear guards to form the assembly. The ear guards of this patent provide a multi-level degree of protection and shock absorbency by means of an inner foam pad and an outer pad of partially compressed foam having a plurality of raised, uncompressed areas or plateaus separated by compressed lands or valleys. However, the ear guard of this patent remains somewhat complex in its construction and adjustability to obtain a proper fit on the user.

In a further patent, U.S. Pat. No. 6,058,516, the present inventor provided a wrestling ear guard comprising a pair of substantially identical mirror image, roughly inverted triangular shaped guards comprising a cup member formed of thin, relatively stiff, resilient sheet material having an inner concave surface and an outer convex surface, a first padded layer applied to the inner concave surface and comprising a roughly inverted triangular portion and outwardly and upwardly extending strap members contiguous with the triangular member at the upper top corners thereof, a second padded layer applied to the outer convex surface and comprising a roughly inverted triangular member corresponding in size to the inverted triangular portion of the first padded layer and being partially compressed over the outer surface thereof, the second layer being secured about its periphery to the first padded layer whereby the cup member is confined between the first padded layer and the second padded layer.

Although suitable for use and providing the protection necessary for wrestlers, these prior devices have their drawbacks in that they rely solely on the compression of foam structures for initial shock absorbency. Foam has limitations with respect to the degree of compression, softness and durability. Externally exposed foam can tear during competition resulting in a loss of protection or postponement of a match to allow a change of equipment. In the present invention, the multilevel degree of shock absorbency and protection of the inventor's prior patents has been adapted to a new structure which relies on the cushioning quality of air trapped between a semi-rigid inner shell and a flexible resilient outer shell.

Air cushions have been used in other structures to provide protection for wearer's. Most notably, helmets have been devised which employ inflatable air bladder constructions such as the following: U.S. Pat. No. 600,778 Frazier, U.S. Pat. No. 2,618,780 Cushman, U.S. Pat. No. 3,999,220 Keltner, U.S. Pat. No. 4,124,904 Matthes, and U.S. Pat. No. 4,233,689 Baron. In addition to a helmet, Keltner applies his structure to shoulder pads and shin and arm guards.

With specific regard to ear protection, Marchello, U.S. Pat. No. 4,551,861 and Jones, et al., U.S. Pat. No. 6,289,522, have incorporated air cushioning, but not in the manner nor with the results obtained by the present inventor.

Specifically, Marchello provides wrestling helmet ear pads that are designed to fasten inside a rigid outer guard wherein the ear pad is formed of a thick, resilient rubber like sheet material molded to form a central ear receiving pocket that is surrounded by bulged cushion forming strips which engage the wearer's head around the ear. These strips bulge away from the inner surface of the outer rigid guard to form resilient compression chambers. Thus, in this ear guard, all of the padding is on the inside of the ear guard against the wearer's head with the result that the entire shock received by the outer ear guard surface is conveyed to the inner padding without any preliminary attenuation.

In Jones, et al., an ear protective member having a variably adjustable expandable bladder on the inner surface of the ear protective member is described. In this structure, the bladder is on the inside and forms a ring which engages the wearer's head around the ear. In this manner, the bladder takes the place of the common foam ring used in other ear protectors. The outer surface of the ear protective member is simply covered with a layer of foam as has been done in the past.

SUMMARY OF THE INVENTION

In contrast to the prior art ear guards, the present invention provides an ear guard wherein initial protection from an exteriorly applied shock is provided by an air cushion formed between a semi-rigid inner shell and a resilient outer shell which are sealed together about cooperating flanges. A foam cushion is provided on the inner surface of the inner shell to fit against the wearer's head around the ear. The structure of the inner and outer shells is such that force from a blow to the outer shell is both cushioned by the air trapped between the inner and outer shell and directed peripherally over the inner shell away from the wearer's ear in a more even distribution than previously obtained by the use of foam. The redirected force is finally absorbed by the foam cushion.

The present invention is an improvement over the prior art and provides an ear guard construction which results in better protection to both the wearer and his opponent and which provides a multi-level degree of protection and shock absorbency. In addition, the invention provides a protective ear guard assembly which is both light weight and effective.

The present invention provides an ear guard comprising;

A semi-rigid inner shell comprising a cup shaped center with a peripheral flange thereabout and at least one aperture substantially centrally located in the cup, a resilient foam pad secured to an inner surface of the flange, and an outer shell of resilient plastic material comprising a cup shaped center, a peripheral flange thereabout and an aperture substantially centrally located in the cup, whereby, the outer shell fits over the inner shell, the outer shell cup is deeper than the inner shell cup and receives the inner shell cup therein whereby a space exists between the inner shell and the outer shell, and the outer shell peripheral flange is sealed to the inner shell peripheral flange, whereby an air cushion is formed between the inner shell and the outer shell.

The present invention further provides a lightweight protective ear guard assembly comprising a pair of ear guards connected by a plurality of adjustable straps to form a wearable assembly, wherein each ear guard comprises an inner semi-rigid shell having a cup shaped center portion forming a concave inner surface adapted to fit over and receive a wearer's outer ear and a convex outer surface and having an aperture located substantially centrally therein, a peripheral outer flange surrounding the center portion and having inner and outer surfaces, the flange having a plurality of strap attaching means thereon, a soft resilient pad corresponding to and covering the inner surface of the flange, and an outer soft resilient shell disposed over the outer surface of the inner shell, the outer shell having a cup shaped center portion with a concave inner surface corresponding to and slightly larger than the convex outer surface of the inner shell, a peripheral flange thereabout, and an aperture located substantially centrally in the outer shell and corresponding to the aperture in the inner shell, the outer shell aperture having a skirt depending therefrom with a peripheral flange thereabout, whereby the peripheral flange of the outer shell is sealed to the peripheral flange of the inner shell and the cup shaped center portion of the outer shell receives the cup shaped center portion of the inner shell and is spaced therefrom whereby a shock absorbing air cushion is formed by the space between the inner shell and the outer shell.

Still further, the present invention provides a lightweight protective wrestling ear guard assembly comprising a pair of matching ear guards, each ear guard comprising, an opaque semi-rigid inner shell comprising a cup shaped center with a peripheral flange thereabout and at least one aperture substantially centrally located in the cup, a resilient foam pad secured to an inner surface of the flange, a transparent outer shell comprising a cup shaped center, a peripheral flange thereabout and an aperture substantially centrally located in said cup, and a skirt surrounding the aperture in the outer shell cup and depending from the inner surface, whereby the outer shell fits over the inner shell, the outer shell cup is deeper than the inner shell cup and receives the inner shell cup therein whereby a space exists between the inner shell and the outer shell, the skirt extends to the inner shell and forms an air channel between the aperture of the inner shell and the aperture of the outer shell and the outer shell peripheral flange is sealed to the inner shell peripheral flange, whereby an air cushion is formed between the inner shell and the outer shell Thus, it is an object of this invention to provide an improved ear guard which combines the shock absorbency of an air cushion and foam.

It is a further object to provide an improved ear guard having a multi-level degree of shock absorbency and ease of adjustment.

Further objects and advantages will become evident from the following drawings and descriptions.

DETAILED DESCRIPTION OF THE INVENTION

Figure 1:
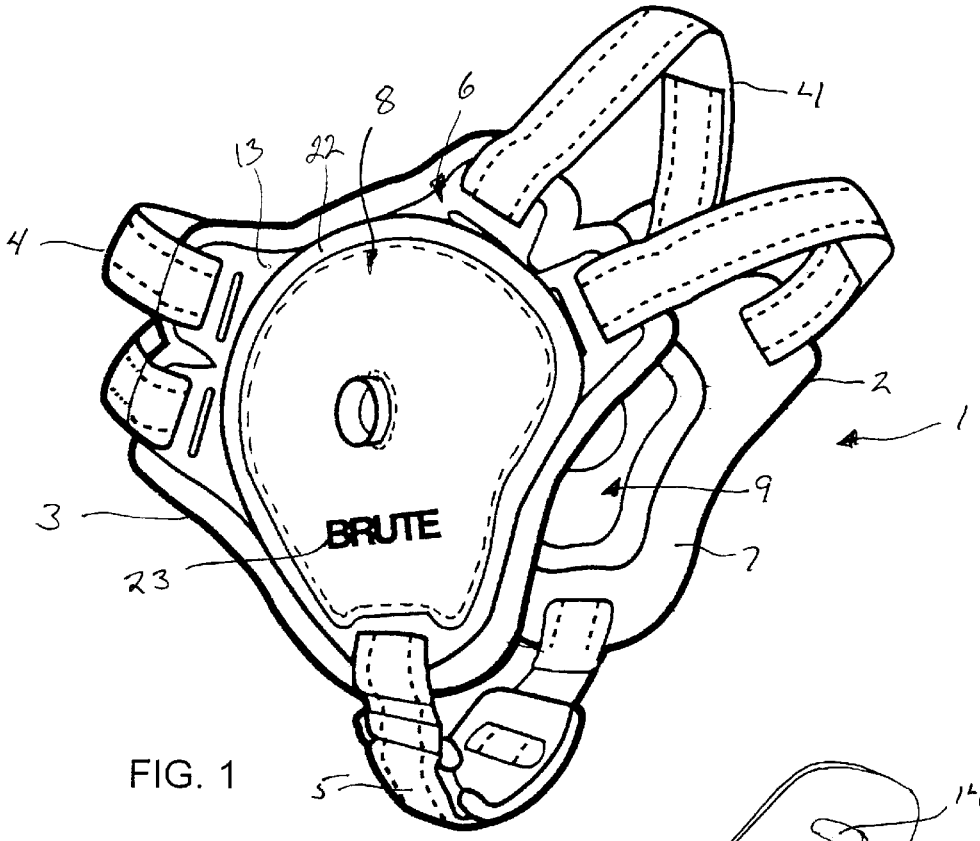
FIG. 1 is an oblique view of the protective ear guard assembly according to the present invention.

FIG. 1 illustrates the protective ear guard assembly 1 of the present invention as worn on the head of a wrestler. The assembly comprises left and right ear guards 2 and 3 joined together in wearable form by adjustable head straps 4 and an adjustable chin strap 5.

As shown in FIG. 1, the left and right ear guards 2 and 3 of the assembly 1 are substantially mirror images and each comprises a semi-rigid inner shell 6, a resilient foam pad 7 adhered to the inner surface of the inner shell 6, and a soft, resilient outer shell 8 adhered to the outer surface of inner shell 6.

Figure 4:
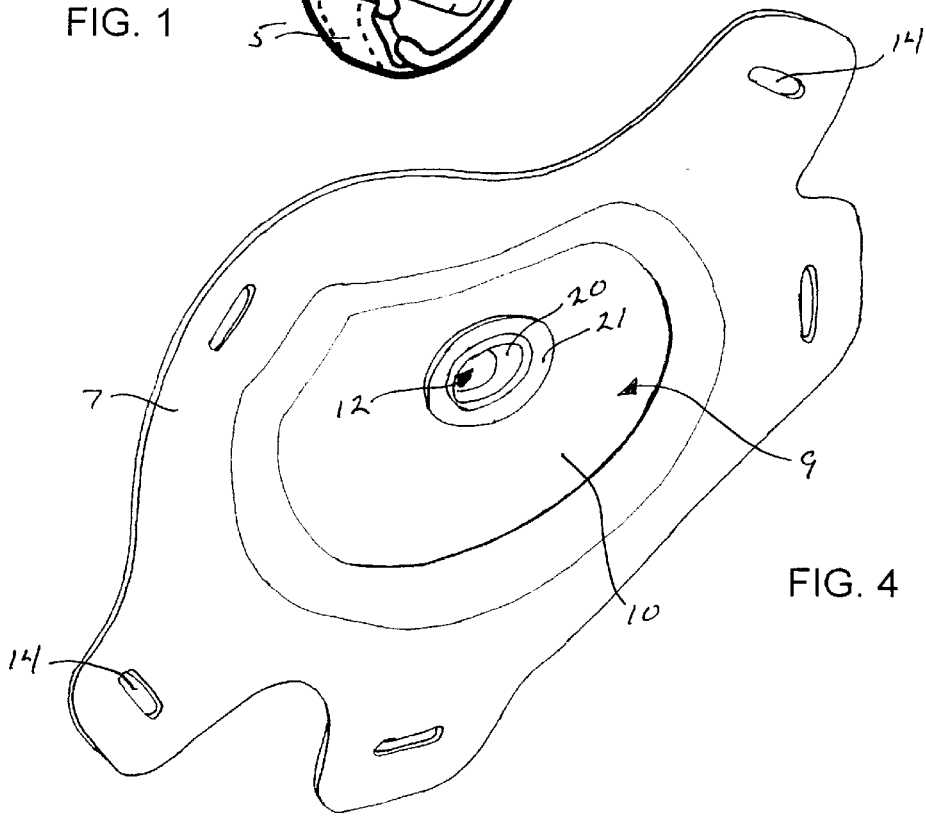
FIG. 4 is an inside view of the ear guard according to the present invention.
Figure 2:
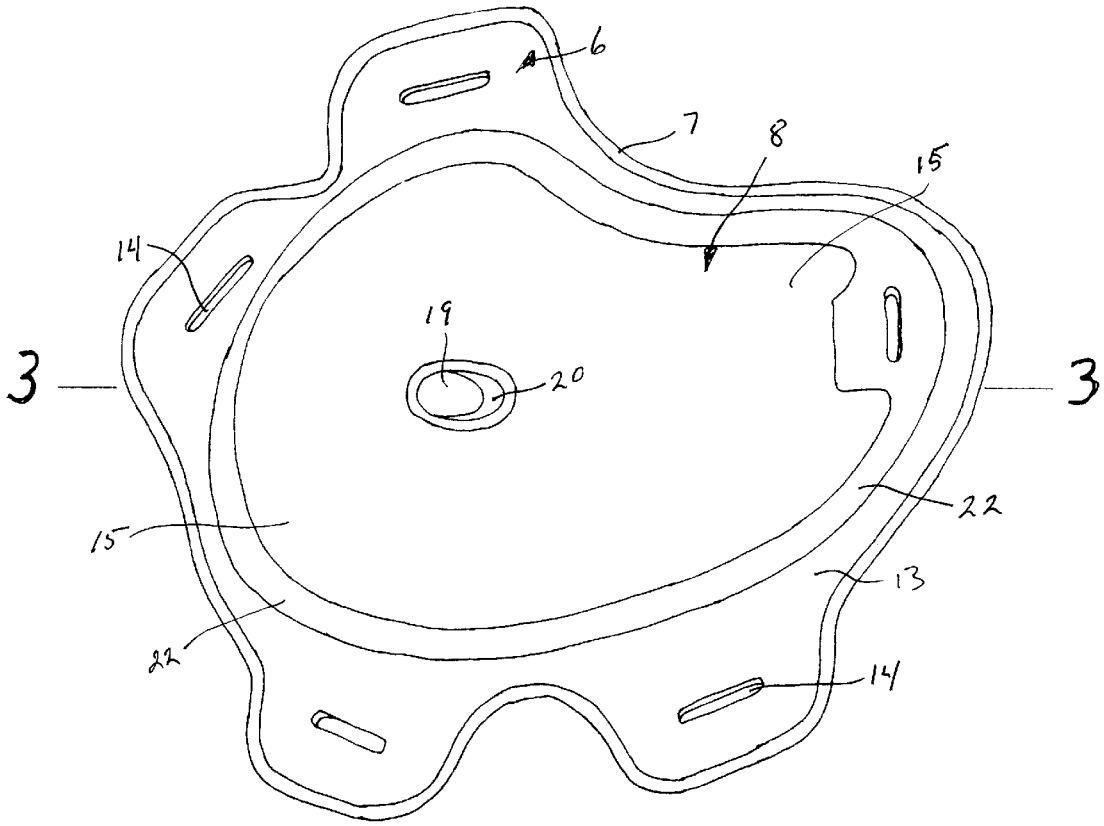
FIG. 2 is an outside view of the ear guard according to the present invention.
Figure 3:
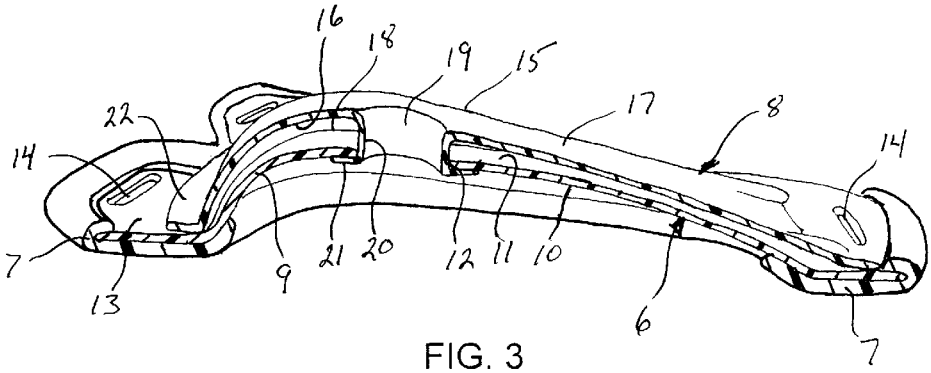
FIG. 3 is a cross section of the ear guard according to the present invention taken along line 3—3 of FIG. 2.

Turning to FIGS. 2–4, inner shell 6 is molded from a semi-rigid plastic material and has a central cup portion 9 with a concave inner surface 10 and a convex outer surface 11. Cup 9 is sized so as to comfortably receive the auricle or outer ear within the cavity formed by the concave surface 10. Substantially centrally located in the cup 9 is at least one aperture 12 which serves to permit the equalization of air pressure over and within the user's ear when the assembly 1 is worn. Although illustrated with only one such aperture 12, ear guards may be constructed with more than one aperture 12 without departing from the spirit of this invention. Around the outer periphery of cup 9 is a flange 13 which includes strap attachment means 14 which are preferably in the form of slot through which the ends of straps 4 and 5 pass other strap attachment means, such as snaps, clips or other structures may be used. At least one end of each strap is adjustable by such means as buckles, snaps or hook and loop fastener to permit adjustment of the strap lengths to fit different sizes of users.

As noted previously, the material from which inner shell 6 is molded is preferably a plastic or high density polymer having sufficient rigidity at a minimum thickness to maintain its shape under stress but with a degree of resiliency which allows the shell 6, and particularly the cup 9 to flex to a certain degree when struck. In this manner, inner shell 6, in particular cup 9, is able to absorb excessive forces and shocks which may be applied to ear guards 2 and 3, and which are beyond those forces absorbed and deflected by the outer resilient shell 8 and resilient foam pad 7. Examples of suitable plastic materials from which the inner shell 6 may be molded include polyurethane, polyvinyl chloride, hytrel or the like. The preferred material is a thermoplastic urethane having a thickness of from 2.0 to 2.2 mm, a density of 1.22 g/cm$^3$ and a hardness of 65D. Preferably, inner shell 6 is opaque and may be molded in any color with or without indicia on the outer surface 11.

Resilient foam pad 7 is secured to the inner surface of flange 13 by mechanical means, such as the ends of straps 4 and 5, or adhesive and extends at least partway into cup 9 of inner shell 6. Preferably, foam pad 7 also extends around the outer edge of flange 13, as shown in FIG. 3, for added protection and to hold the foam pad 7 in place. The material of resilient foam pad 7 is preferably EVA foam having a density of from 0.08 to 0.09 g/cm$^3$ and a thickness of 8 to 12 mm. Other foams, both closed cell and open cell may used, such as polyethylene, polyurethane and irradiation cross-linked polyethylene. Foam pad 7 may also be provided with a thin, lightweight woven or non-woven fabric cover, such as tricot or Lycra®, which provides a smooth, low friction surface for added strength and comfort.

Outer shell 8 is molded from a flexible, soft, resilient plastic material that is compatible with the material of inner shell 6 so as to permit radio wave, sonic and/or heat welding and may be opaque, semi-transparent or transparent. As with inner shell 6, the preferred material is thermoplastic urethane with a thickness of 2.0 to 2.2 mm. However, the density is lower, on the order of 1.17 g/cm$^3$ and a hardness of 75A. Like inner shell 6, outer shell 8 has a central cup portion 15 with a concave inner surface 16 and a convex outer surface 17 and a surrounding peripheral flange 22. Cup 15 is sized so as to receive the cup 9 of inner shell 6 when outer shell 8 is place thereover. In that respect, cup 15 of outer shell 8 has a depth in excess of that of cup 9 of inner shell so that an air space 18 is created between inner shell 6 and outer shell 8. Flange 22 of outer shell 8 is sealed to flange 13 of inner shell 6, preferably by sonic or heat welding so as to trap a cushion of air between cup 9 of inner shell 6 and cup 15 of outer shell 8.

Substantially centrally located in the cup 15 is at least one aperture 19 which cooperates with aperture 12 of cup 9 to permit the equalization of air pressure over and within the user's ear when the assembly 1 is worn. Although illustrated with only one such aperture 19, ear guards may be constructed with more than one aperture 19 to cooperate with plural apertures 12 in inner shell 6, without departing from the spirit of this invention. Depending from the periphery of aperture 19 is a skirt 20 that is integrally molded as part of outer shell 8. Skirt 20 spans the distance between the inner surface 16 of cup 15 and the outer surface 11 of cup 9 and forms a duct between the aperture 19 of outer shell 8 and the aperture 12 of inner shell 6. Surrounding the free end of skirt 20 is a peripheral flange 21 by which skirt 20 is sealed to cup 9. Flange 21 may be sealed to the outer surface 11 of cup 9 surrounding aperture 12. However, preferably, the end of skirt 20 passes through aperture 12 and flange 21 is sealed to the inner surface 10 of cup 9 surrounding aperture 12 by sonic or heat welding. Sealing of skirt flange 21 to the surface of cup 9 around aperture 12 completes the entrapment of a cushion of air between cup 9 of inner shell 6 and cup 15 of outer shell 8.

The above-described construction for ear guards 2 and 3 provides a greater degree of protection to users and opponents and greater absorbance of shock than is achieved with the prior art constructions of Marchello and Dubner. The use of an air cushion trapped between the inner and outer shells 6 and 8 allows the ear guards 2 and 3 to be made with a shallower profile while maintaining or increasing the level of protection over prior art ear guards. In addition, the smooth surface of the outer shell 8 presents a low friction surface which allows the wearer's head to slide easily across a wrestling mat.

The structure of the ear guards of the present invention provides three levels of shock absorption. When in use, the first contact with the ear guards is on the outer surface 17 of the soft resilient outer shell 8 which flexes relative to the semi-rigid inner shell 6. Because the outer shell 8 is sealed to the inner shell 6 around the peripheral flange 22 and the skirt flange 21, the air trapped between inner shell 6 and outer shell 8 is compressed and absorbs some of the shock. In addition, the fluid nature of air cooperates with the convex outer surface 11 of cup 9 to direct excess force radially and outwardly over the surface of cup 9 toward the peripheral flange 13 of inner shell 6 where it is transferred to and absorbed by foam pad 7. Furthermore, because air is a fluid medium, and relatively unaffected by atmospheric temperature, it acts in a manner unlike the prior art foam padding to evenly disperse the forces of shock over the ear guard.

In the event a sudden shock is applied to the outer surface of ear guards 2 and 3, not only is a portion of that shock absorbed and redirected by the structure of the ear guards 2 and 3 as described above, but, where the force of the shock is sufficient, cup 9 of inner shell 6 will also flex and thus absorb and divert the shock radially outward. In this manner less of the shock and associated pressure is transmitted to the user's ears.

The structure of the ear guard of the present invention and its method of manufacture has added benefits in that it permits the ear guard to be manufactured in a plurality of colors to match those of national, regional and/or local teams. In addition, by manufacturing outer shell 8 out of a semi-transparent or transparent thermoplastic urethane one may place decorative and/or identifying indicia or indicia sheets 23 or the like between inner shell 6 and outer shell 8 during assembly, thus providing a degree of customization to the ear guards for consumers.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A lightweight protective ear guard assembly comprising a pair of ear guards connected by a plurality of adjustable straps to form a wearable assembly, wherein each ear guard comprises an inner semi-rigid shell having a cup shaped center portion forming a concave inner surface adapted to fit over and receive a wearer's outer ear and a convex outer surface and having an aperture located substantially centrally therein, a peripheral outer flange surrounding said center portion and having inner and outer surfaces, said flange having a plurality of strap attaching means thereon, a soft resilient pad corresponding to and covering the inner surface of said flange, and an outer soft resilient shell disposed over the outer surface of said inner shell, said outer shell having a cup shaped center portion with a concave inner surface corresponding to and slightly larger than the convex outer surface of said inner shell, a peripheral flange thereabout, and an aperture located substantially centrally in said outer shell and corresponding to said aperture in said inner shell, said outer shell aperture having a skirt depending therefrom with a peripheral flange thereabout, whereby said peripheral flange of said outer shell is sealed to said peripheral flange of said inner shell and said cup shaped center portion of said outer shell receives said cup shaped center portion of said inner shell and is spaced therefrom whereby a shock absorbing air cushion is formed by the space between said inner shell and said outer shell.

2. The ear guard assembly of claim 1 wherein said soft resilient pad comprises a closed cell or open cell foam.

3. The ear guard assembly of claim 2 wherein said foam is an ethylene vinyl acetate copolymer.

4. The ear guard assembly of claim 1, wherein said skirt depending from said outer shell aperture passes through said inner shell aperture and said peripheral flange about said skirt is sealed to the inner surface of said inner shell around said inner shell aperture thereby providing an air channel between the concave inner surface of said inner shell and the exterior of said ear guard.

5. The ear guard assembly of claim 1, wherein said peripheral flange about said skirt is sealed to the outer convex surface of said inner shell about said inner shell aperture, whereby said skirt forms a conduit connecting said inner shell aperture and said outer shell aperture whereby an air channel is provided between the inside of said ear guard and the exterior.

6. The ear guard assembly of claim 1 wherein said inner shell is a semi-rigid polymer and said outer shell is a resilient polymer.

7. The ear guard assembly of claim 6, wherein said semi-rigid polymer and said resilient polymer are thermoplastic urethanes of differing densities.

8. The ear guard assembly of claim 1 wherein said inner and outer shell are sealed together by welding.

9. A lightweight protective ear guard comprising;

a semi-rigid inner shell comprising a cup shaped center with a peripheral flange thereabout and at least one aperture substantially centrally located in said cup, a resilient foam pad secured to an inner surface of said flange, and a resilient outer shell comprising a cup shaped center, a peripheral flange thereabout and an aperture substantially centrally located in said cup, whereby, said outer shell fits over said inner shell, said outer shell cup is deeper than said inner shell cup and receives said inner shell cup therein whereby a space exists between said inner shell and said outer shell and said outer shell peripheral flange is sealed to said inner shell peripheral flange, whereby an air cushion is formed between said inner shell and said outer shell.

10. The ear guard of claim 9 further comprising a skirt surrounding said aperture in said outer shell cup and depending from the inner surface thereof, whereby said skirt forms an air channel between said aperture of said inner shell and said aperture of said outer shell.

11. The ear guard of claim 10 further comprising a peripheral flange about the end of said skirt, said flange engaging said inner shell about said aperture in said inner shell cup.

12. The ear guard of claim 11, wherein said skirt passes through said aperture in said inner shell cup and said flange about said skirt is sealed to said inner shell.

13. The ear guard of claim 9 wherein said inner shell is an opaque semi-rigid polymer and said outer shell is a transparent resilient polymer.

14. The ear guard of claim 13, wherein said semi-rigid polymer and said resilient polymer are the same polymer of different densities.

15. The ear guard of claim 9 wherein said resilient foam pad is an open or closed cell foam with a density of from 0.08 to 0.01 g/cm$^2$.

16. The ear guard of claim 9 further comprising a plurality of strap attaching means on said peripheral flange of said inner shell.

17. The ear guard of claim 16 further comprising a plurality of adjustable strap members attached to said strap attaching means.

18. A lightweight protective wrestling ear guard assembly comprising a pair of matching ear guards, each ear guard comprising, a semi-rigid inner shell comprising a cup shaped center with a peripheral flange thereabout and at least one aperture substantially centrally located in said cup, a resilient foam pad adhered to an inner surface of said flange, a resilient outer shell comprising a cup shaped center, a peripheral flange thereabout and an aperture substantially centrally located in said cup, and a skirt surrounding said aperture in said outer shell cup and depending from the inner surface, whereby said outer shell fits over said inner shell, said outer shell cup is deeper than said inner shell cup and receives said inner shell cup therein whereby a space exists between said inner shell and said outer shell, said skirt extends to said inner shell and forms an air channel between said aperture of said inner shell and said aperture of said outer shell and said outer shell peripheral flange is sealed to said inner shell peripheral flange, whereby an air cushion is formed between said inner shell and said outer shell.

19. The ear guard assembly of claim 18, further comprising a plurality of strap attaching means on said ear guards and a plurality of adjustable straps connected between corresponding strap attaching means on each ear guard to form an adjustable wearable assembly for placement on a wrestler's head whereby said ear guards fit over and receive the wrestler's outer ears.

20. The ear guard assembly of claim 19, wherein said inner shell is opaque and said outer shell is transparent and further comprising indicia located between said inner shell and said outer shell so as to be contained within said space between said inner and outer shells and to be visible through said outer shell.

* * * * *